US009086671B2

(12) United States Patent
Ichinose et al.

(10) Patent No.: US 9,086,671 B2
(45) Date of Patent: Jul. 21, 2015

(54) IMAGE FORMING APPARATUS INCLUDING CLEANING UNIT FOR REMOVING DEVELOPING MATERIAL

(71) Applicant: CANON KABUSHIKI KAISHA, Tokyo (JP)

(72) Inventors: Kimitaka Ichinose, Mishima (JP); Kazuhiro Funatani, Mishima (JP); Tetsuichiro Fujimoto, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 59 days.

(21) Appl. No.: 14/083,650

(22) Filed: Nov. 19, 2013

(65) Prior Publication Data

US 2014/0169821 A1 Jun. 19, 2014

(30) Foreign Application Priority Data

Dec. 18, 2012 (JP) ..... 2012-276113

(51) Int. Cl.
*G03G 15/00* (2006.01)
*G03G 21/00* (2006.01)

(52) U.S. Cl.
CPC ..... *G03G 21/0005* (2013.01); *G03G 15/556* (2013.01); *G03G 21/0094* (2013.01); *G03G 21/0011* (2013.01)

(58) Field of Classification Search
CPC .... G03G 13/11; G03G 15/11; G03G 21/0088
USPC ..... 399/71, 34, 127, 249, 343, 348, 357, 399/358
See application file for complete search history.

(56) References Cited

U.S. PATENT DOCUMENTS

| | | | | |
|---|---|---|---|---|
| 6,070,047 | A | 5/2000 | Ichinose et al. | |
| 6,393,250 | B1 | 5/2002 | Tsukida et al. | |
| 2010/0329721 | A1* | 12/2010 | Kobayashi | 399/71 |
| 2012/0051785 | A1 | 3/2012 | Nakai et al. | |
| 2013/0230332 | A1* | 9/2013 | Ishii | 399/27 |

FOREIGN PATENT DOCUMENTS

| | | | |
|---|---|---|---|
| JP | 2008-216944 | A | 9/2008 |
| JP | 2009-205109 | A | 9/2009 |
| JP | 2012-022039 | A | 2/2012 |

OTHER PUBLICATIONS

U.S. Appl. No. 14/085,965, filed Nov. 21, 2013.

* cited by examiner

*Primary Examiner* — Rochelle-Ann J Blackman
(74) *Attorney, Agent, or Firm* — Fitzpatrick, Cella, Harper & Scinto

(57) ABSTRACT

An image forming apparatus includes a control unit, which is configured to, if a developing material image transferred to another member is formed on an image carrier, obtain a print ratio that is a ratio of the area of the formed developing material image with respect to the area of a developing material image capable of being formed on a recording material that is to be printed on, and a threshold value corresponding to a consumption amount of the developing material in a image forming unit and a number of sheets printed, and control an amount of developing material that is to be supplied to a cleaning unit in accordance with the print ratio and the threshold value.

30 Claims, 10 Drawing Sheets

FIG. 5

| Y(X-1) | LESS THAN 3.5 mg | GREATER THAN OR EQUAL TO 3.5 mg, LESS THAN 7 mg | GREATER THAN OR EQUAL TO 7 mg, LESS THAN 10.5 mg | GREATER THAN OR EQUAL TO 10.5 mg, LESS THAN 14 mg | GREATER THAN OR EQUAL TO 14 mg, LESS THAN 28 mg | GREATER THAN OR EQUAL TO 28 mg, LESS THAN 56 mg | GREATER THAN OR EQUAL TO 56 mg |
|---|---|---|---|---|---|---|---|
| M(X) | 40% | 13.3% | 8% | 5.7% | 3.3% | 1.7% | 0.8% |

FIG. 6

| DIFFERENCE BETWEEN M(X) AND k(X) | LESS THAN 1% | GREATER THAN OR EQUAL TO 1%, LESS THAN 3% | GREATER THAN OR EQUAL TO 3%, LESS THAN 5% | GREATER THAN OR EQUAL TO 5%, LESS THAN 7% | GREATER THAN OR EQUAL TO 7% |
|---|---|---|---|---|---|
| LENGTH (X) IN SUB-SCANNING DIRECTION | 0.8mm | 2.4mm | 4mm | 5.6mm | 7.2mm |

FIG. 9A

| Z(X) | LESS THAN 7 mg | GREATER THAN OR EQUAL TO 7 mg, LESS THAN 14 mg | GREATER THAN OR EQUAL TO 14 mg, LESS THAN 28 mg | GREATER THAN OR EQUAL TO 28 mg, LESS THAN 56 mg | GREATER THAN OR EQUAL TO 56 mg, LESS THAN 112 mg | GREATER THAN OR EQUAL TO 112 mg |
|---|---|---|---|---|---|---|
| M(X) | 1.25% | 3.75% | 7.5% | 15% | 30% | 60% |

FIG. 9B

| M(X) | | Wi-W(X-1) | | | | | |
|---|---|---|---|---|---|---|---|
| | | GREATER THAN OR EQUAL TO 160 g, LESS THAN 200 g | GREATER THAN OR EQUAL TO 120 g, LESS THAN 160 g | GREATER THAN OR EQUAL TO 80 g, LESS THAN 120 g | GREATER THAN OR EQUAL TO 40 g, LESS THAN 80 g | GREATER THAN OR EQUAL TO 20 g, LESS THAN 40 g | LESS THAN 20 g |
| X-1 | LESS THAN 2000 | 5% | 3.9% | 2.8% | 1.7% | 0.6% | 0.3% |
| | GREATER THAN OR EQUAL TO 2000, LESS THAN 4000 | 6.4% | 5% | 3.6% | 2.1% | 0.7% | 0.4% |
| | GREATER THAN OR EQUAL TO 4000, LESS THAN 6000 | 9% | 7% | 5% | 3% | 1% | 0.5% |
| | GREATER THAN OR EQUAL TO 6000, LESS THAN 8000 | 15% | 11.7% | 8.3% | 5% | 1.7% | 0.8% |
| | GREATER THAN OR EQUAL TO 8000, LESS THAN 9000 | 30% | 23.3% | 16.7% | 10% | 5% | 1.7% |
| | GREATER THAN OR EQUAL TO 9000, LESS THAN 10000 | 90% | 70% | 50% | 30% | 15% | 5% |
| | GREATER THAN OR EQUAL TO 10000 | 100% | | | | | |

IMAGE FORMING APPARATUS INCLUDING CLEANING UNIT FOR REMOVING DEVELOPING MATERIAL

BACKGROUND OF THE INVENTION

1. Field of the Invention

The present disclosure relates to an image forming apparatus such as a copier, a printer, or a fax device that uses an electrophotographic method or an electrostatic recording method.

2. Description of the Related Art

An image forming apparatus performs printing by, for example, forming toner images on an image carrier such as a photosensitive member or an intermediate transfer belt and ultimately transferring these toner images to a recording material that is also an image carrier. Note that in order to remove remaining toner that has not been transferred from an image carrier to another image carrier, or in other words, transfer remnant toner, a rubber cleaning blade is used as a cleaning unit in the image forming apparatus. Here, transfer remnant toner also acts as a lubricant and suppresses the frictional force between the cleaning blade and the image carrier. In other words, the transfer remnant toner suppresses curling-up of the tip of the cleaning blade caused by excessive friction between the cleaning blade and the image carrier, and the like, and prevents cleaning defects from occurring.

However, if the amount of transfer remnant toner is not sufficient, it is not possible to sufficiently reduce friction. Because of this, Japanese Patent Laid-Open No. 2009-205109 discloses that if the area of a formed image is small, toner is mandatorily supplied to the image carrier in order to reduce the frictional force between the cleaning blade and the image carrier.

For example, if printing is performed successively on multiple recording materials and many of the images to be printed on the recording materials have a large area, an amount of transfer remnant toner that is sufficient to suppress the frictional force exists in the vicinity of the cleaning blade. Accordingly, in such a case, toner does not need to be mandatorily supplied to the image carrier even if the areas of the images that are to be printed on some recording materials are small. Similarly, even in the case of printing images having small areas, if images having large areas have been printed prior to the printing of images having small areas, the amount of transfer remnant toner is sufficient to suppress the frictional force and it is not necessary to mandatorily supply toner. However, with the method disclosed in Japanese Patent Laid-Open No. 2009-205109, there is a possibility that toner will be mandatorily supplied, even in such cases. In this way, with the method disclosed in Japanese Patent Laid-Open No. 2009-205109, more toner than is necessary is supplied, and toner, or in other words, developing material is needlessly consumed.

SUMMARY OF THE INVENTION

According to an aspect of the present invention, an image forming apparatus includes: an image carrier; an image forming unit configured to form a developing material image on the image carrier using developing material; a cleaning unit configured to remove remaining developing material that was not transferred from the image carrier to another member; and a control unit configured to, in order to supply developing material to the cleaning unit, control the image forming unit such that a developing material image that is not to be transferred to the other member is formed on the image carrier. The control unit is further configured to, if a developing material image that is to be transferred to the other member for printing is formed on the image carrier, obtain a print ratio that is a ratio of the area of the formed developing material image with respect to the area of a developing material image capable of being formed on the recording material that is to be printed on, and a threshold value that corresponds to a consumption amount of the developing material in the image forming unit and a number of sheets printed by the image forming unit in a period from a first time point at time of printing to a second time point earlier than the first time point by a predetermined period, and control an amount of developing material that is to be supplied to the cleaning unit in accordance with the print ratio and the threshold value.

Further features of the present invention will become apparent from the following description of exemplary embodiments with reference to the attached drawings.

BRIEF DESCRIPTION OF THE DRAWINGS

FIG. 5 is a diagram for describing determination of a threshold value for determining whether or not a toner supply operation is necessary according to an embodiment.

FIG. 6 is a diagram for describing determination of a toner supply amount in the toner supply operation, according to an embodiment.

FIGS. 9A and 9B are diagrams for describing determination of a threshold value for determining whether or not a toner supply operation is necessary according to an embodiment.

DESCRIPTION OF THE EMBODIMENTS

Figure 1:
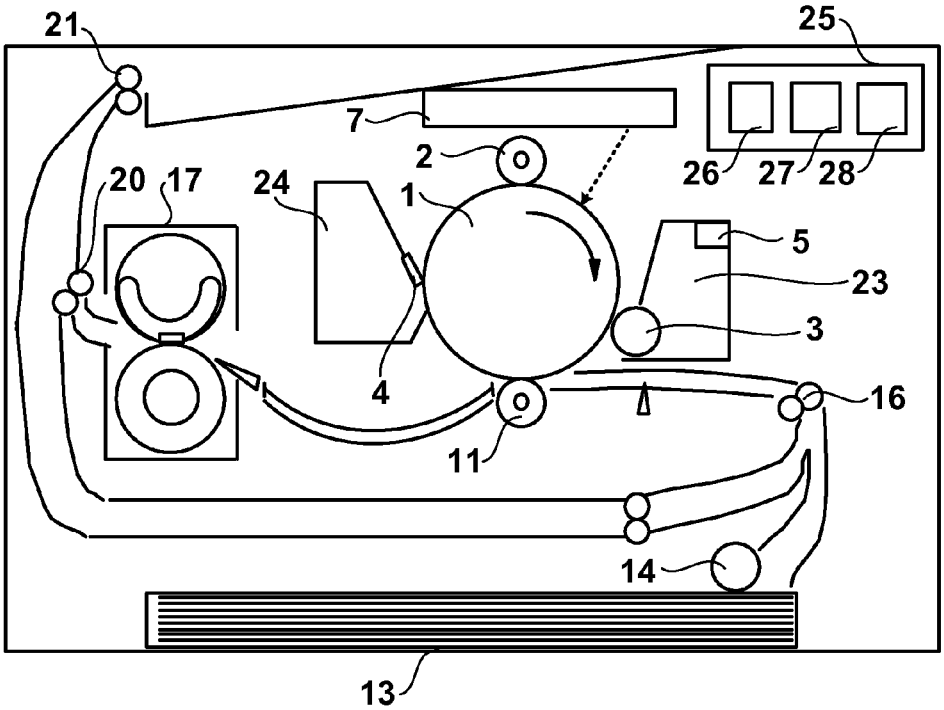
FIG. 1 is a schematic configuration diagram of an image forming apparatus according to an embodiment.

Exemplary embodiments of the present invention will be described below with reference to the accompanying drawings. Note that constituent elements that are not needed in the description of the embodiments are not included in the drawings described below. Note that the embodiments described below are exemplary and are not intended to limit the scope of the present invention.

First Embodiment

FIG. 1 is a schematic configuration diagram of an image forming apparatus according to the present embodiment and shows a monochrome image forming apparatus that uses an electrophotographic method. A photosensitive member 1, which is an image carrier, is rotated in the direction indicated by the arrow in the drawing, and a charging unit 2 charges the surface of the photosensitive member 1 a negative potential. An exposure unit 7 exposes the surface of the photosensitive member 1 to light based on image signals and forms an electrostatic latent image on the surface of the photosensitive member 1. A developing unit 23 holds black toner (developing material), supplies the toner to the electrostatic latent image by means of a negative-polarity developing bias applied by a developing roller 3, and makes the electrostatic latent image visible as a toner image (developing material image). A roller 14 and a roller 16 convey a recording material stored in a cassette 13 to a nip portion between a transfer roller 11 and the photosensitive member 1. The transfer roller 11 applies a bias having a positive polarity and transfers the toner image on the photosensitive member 1 to the recording material in the nip portion. The recording material onto which the toner image is transferred is conveyed to a fixing unit 17 and the fixing unit 17 applies heat and pressure to the recording material and fixes the toner image to the recording material. Rollers 20 and 21 eject the recording material onto which the toner image was fixed to the exterior of the apparatus. An image forming unit that forms a toner image on the photosensitive member 1 is configured in this way by the charging unit 2, the exposure unit 7, and the developing unit 23.

The transfer remnant toner that was not transferred from the photosensitive member 1 to the recording material and remains on the photosensitive member 1 is removed by a cleaning blade 4 and recovered in a toner recovery container 24. Here, in the present embodiment, the photosensitive member 1, the charging unit 2, the developing unit 23 in which the developing roller 3 is included, the cleaning blade 4, the toner recovery container 24, and a storage medium 5 are integrated as a cartridge that is detachable from the image forming apparatus. Here, the storage medium 5 stores the number of sheets X that have been printed using that cartridge, and a total toner consumption amount W(X), which is the amount of toner that has been consumed for printing X sheets.

Also, the image forming apparatus includes a control board 25 that includes an electric circuit for controlling the image forming apparatus. The control board 25 includes a CPU 26 that is a control unit, a non-volatile memory 27, and a RAM 28. Note that if re-writing is not necessary, the non-volatile memory 27 can be a ROM. The CPU 26 performs overall control of operations of the image forming apparatus, such as control of conveying recording materials, control related to image formation, such as forming toner images on the photosensitive member 1 and transferring toner images from the photosensitive member 1 to the recording material, and control related to malfunction detection. Constants and tables used in the control of the image forming apparatus are stored in the non-volatile memory 27, and the RAM 28 is used for storing various kinds of information that changes when control of the image forming apparatus is performed.

The cleaning blade 4 is made of an elastic rubber such as urethane and is pressed against the photosensitive member drum 1 in the opposite direction at an applied linear pressure of around 0.5 N/cm. When the frictional force between the cleaning blade 4 and the photosensitive member 1 is large, bending occurs in the cleaning blade 4, and as a result, a gap through which toner passes forms between the cleaning blade 4 and the photosensitive member 1, and thereby the cleaning performance deteriorates. Furthermore, it is also possible for the tip of the cleaning blade 4 to curl up. In order to prevent this kind of situation, the edge portion of the cleaning blade 4 is coated with a lubricant, and thereby measures are taken to reduce the frictional force between the cleaning blade 4 and the photosensitive member 1. However, the amount of lubricant decreases with use. Accordingly, in the present embodiment, toner is used as a lubricant, and a toner supply operation of supplying toner for maintaining the cleaning performance is executed on the cleaning blade 4 as necessary. For example, during successive image formation processes, the CPU 26 determines whether or not the toner supply operation is needed between image formation processes with respect to two successive recording materials, after the image formation processes have ended, or the like, and if it is needed, the toner supply operation is executed. Note that in order for the toner that was supplied by the developing unit 23 to the photosensitive member 1 to be delivered to the cleaning blade 4, the toner is maintained on the photosensitive member 1 by separating the transfer roller 11 from the photosensitive member 1, or by outputting the transfer bias of a negative polarity when the toner supply operation is performed.

Processing for the CPU 26 to determine whether or not the toner supply operation is necessary will be described below with reference to FIG. 2. Note that in the description below, a print ratio k is defined by equation (1) below.

$$k=Ai/At \tag{1}$$

Here, At is the largest area of a toner image that can be formed on the recording material, and Ai is the area of the electrostatic latent image that was actually formed due to the exposure by means of the exposure unit 7, or in other words, it is the area of the portion that the toner is attached to in the image that was formed. In other words, the print ratio k is the ratio of the area of the toner image that was actually formed, with respect to the largest area of a toner image that is formable on the recording material.

The CPU 26 forms an image to be printed on one recording material in step S10, and in step S11, reads out a threshold value M that is stored in advance in the non-volatile memory 27 or the RAM 28. Next, in step S12, the CPU 26 calculates the print ratio k for the image that was formed in step S10. In step S13, the CPU 26 compares the print ratio k and the threshold value M, and if the print ratio k is less than the threshold value M, determines that the toner supply operation is needed and executes the toner supply operation in step S14. On the other hand, if the print ratio k is greater than or equal to the threshold value M, the toner supply operation is not executed, and the processing ends. Note that a configuration is possible in which, if the print ratio k is less than or equal to the threshold value M, the toner supply operation is executed, and if the print ratio k is greater than the threshold value M, the toner supply operation is not executed, or in other words, the amount of toner (i.e., the amount of developing material) to be supplied to the cleaning blade 4 is set to zero.

If the print ratio k is high, there is a large amount of toner in the toner image formed on the photosensitive member 1, and accordingly, it can be thought that the amount of transfer remnant toner will be large as well. Accordingly, even if the toner supply operation is not performed, the cleaning performance can be maintained. By implementing this kind of control, toner is prevented from being needlessly consumed.

Figure 3:
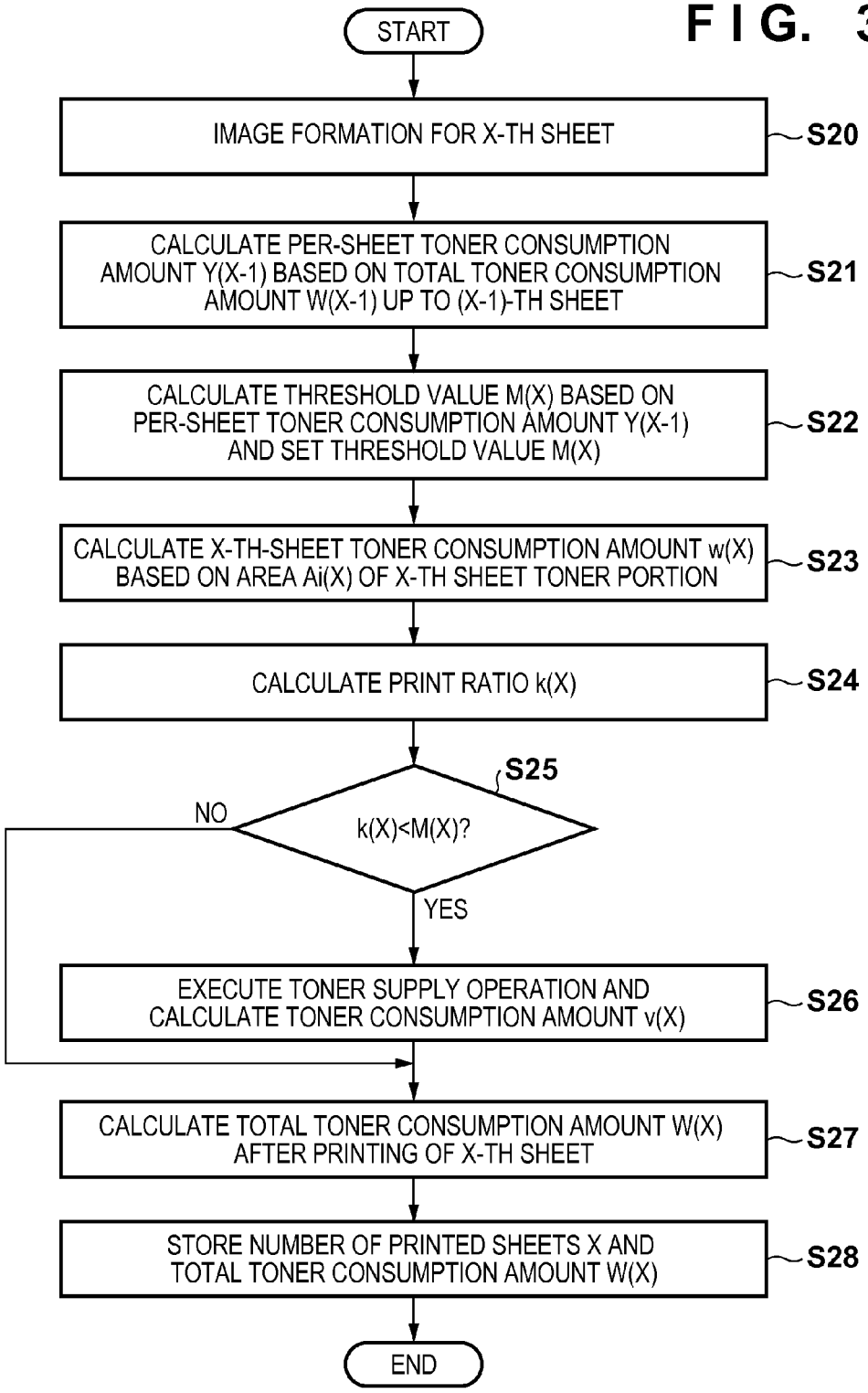
FIG. 3 is a flowchart of print processing according to an embodiment.

Note that although the threshold value M may be a fixed value, in the present embodiment, it is changed according to the usage status of the image forming apparatus. Processing in the case of changing the threshold value M will be described below with reference to FIG. 3. Note that in the description below, the print ratio k in the image formation for the X-th sheet is expressed as k(X), and the threshold value M that is used for determining whether or not it is necessary to execute the toner supply operation after the image formation for the X-th sheet is expressed as M(X).

The CPU 26 performs image formation for the X-th sheet in step S20 and reads out the total number of sheets that have been printed up to the current time, or in other words, the value (X−1) and the total toner consumption amount W(X−1) up to the current time from the storage medium 5 in step S21. The CPU 26 subsequently obtains the per-sheet toner consumption amount Y(X−1), or in other words, the per-sheet developing material consumption amount Y(X−1), according to equation (2) below.

$$Y(X-1)=W(X-1)/(X-1) \quad (2)$$

Figure 4:
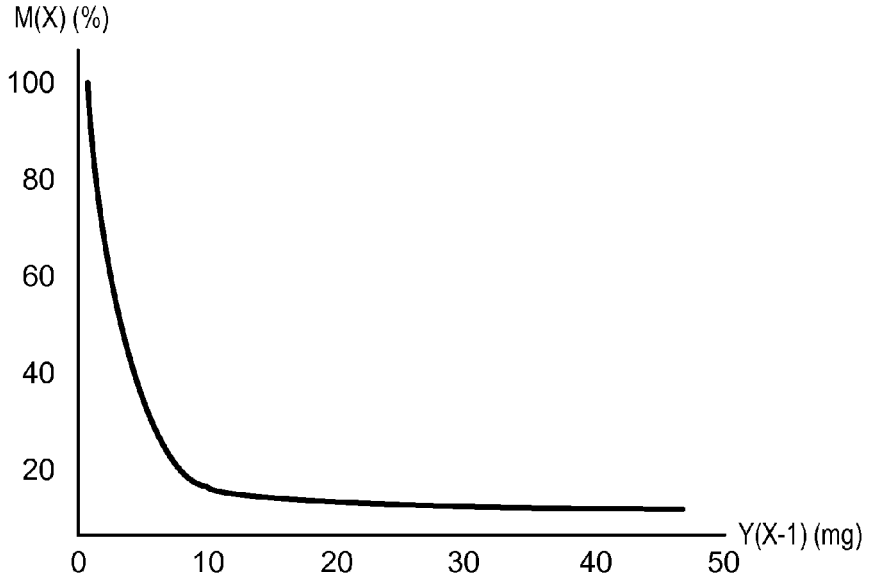
FIG. 4 is a diagram for describing determination of a threshold value for determining whether or not a toner supply operation is necessary according to an embodiment.

In step S22, the CPU 26 subsequently calculates the threshold value M(X) based on the per-sheet toner consumption amount Y(X−1) that was obtained in step S21 and sets it in the RAM 28. Note that the threshold value M(X) is obtained based on the relationship between the per-sheet toner consumption amount Y(X−1) and the threshold value (M), which is stored in advance in the non-volatile memory 27 or the RAM 28, for example. FIG. 4 shows an example of a relationship between the per-sheet toner consumption amount Y(X−1) and the threshold value (M). In the relationship of the present embodiment, the threshold value M(X) decreases overall as the value of Y(X−1) increases. Subsequently, in step S23, the CPU 26 calculates toner consumption amount w(X) at the X-th-sheet image formation based on the area Ai(X) of the toner portion that was formed by the printing of the X-th sheet using equation (3) below.

$$w(X)=\alpha\times Ai(X) \quad (3)$$

Here, α represents the amount of applied toner per unit area and is, for example, a value stored in the non-volatile memory 27, or a value obtained by correcting the value stored in the non-volatile memory 27 according to environment temperature and humidity, cartridge use history, and the like.

Figure 2:
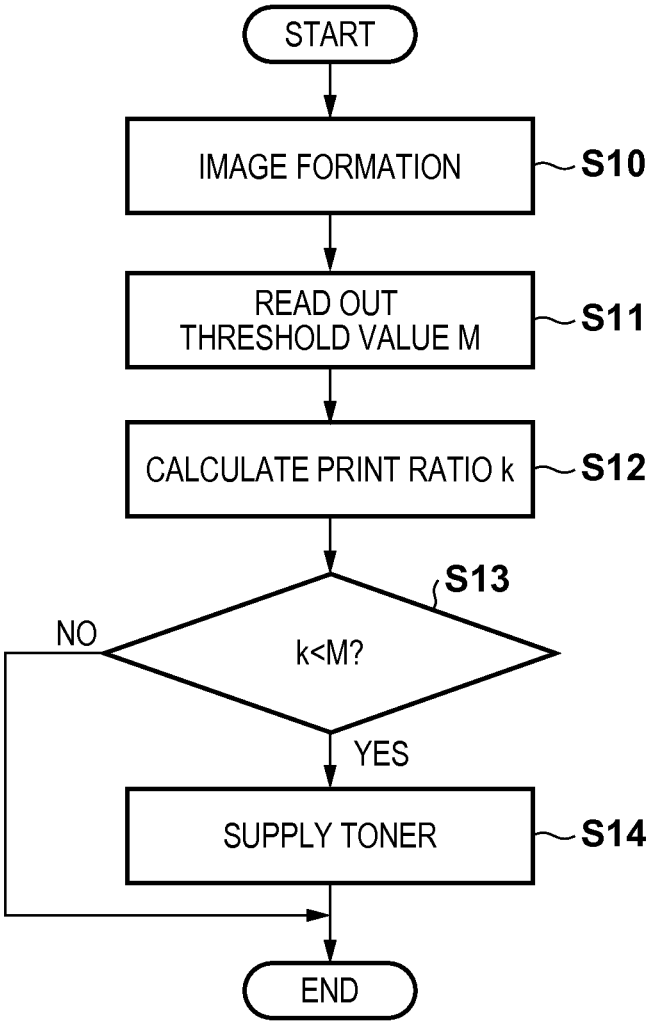
FIG. 2 is a flowchart of processing for determining whether or not a toner supply operation is necessary according to an embodiment.

In step S24, the CPU 26 calculates the print ratio k(X) based on the area Ai(X) of the toner portion of the image that was formed with the printing of the X-th sheet, and in step S25, determines whether or not it is necessary to execute the toner supply operation, similarly to step S13 in FIG. 2. If the CPU 26 determines in step S25 that the toner supply operation is necessary, in step S26, the toner supply operation is executed and a toner supply operation toner consumption amount v(X) in the toner supply operation is calculated. It is possible to obtain the toner consumption amount v(X) using equation (4), similarly to equation (3).

$$v(X)=\alpha\times As(X) \quad (4)$$

Here, As(x) is the exposure area in the toner supply operation, or in other words, it is the area of the toner portion of the image that was formed with the toner supply operation. Note that if the area exposed to light by the exposure unit 7 in the toner supply operation is always the same As0, the toner consumption amount v(X) is a fixed value shown in equation (5) below.

$$v(X)=\alpha\times As0 \quad (5)$$

For example, in order to maintain the cleaning performance, it is necessary to supply around 0.7 mg of toner in the toner supply operation. Although the coefficient α varies depending on the situation, here, it is 0.004 mg/mm$^2$. In this case, for example, the lengths in the main scanning and sub-scanning directions are 220 mm and 4 mm respectively, and a 20% uniform halftone image is formed with the toner supply operation. Accordingly, the area of the toner portion is As0=220×4×0.2=176 mm$^2$, and 0.704 mg (=0.004×176) of toner can be supplied.

After the toner supply operation is executed, in step S27, the CPU 26 obtains the total toner consumption amount after printing of the X-th sheet W(X) using equation (6) below, and in step S28, the number of printed sheets X and the total toner consumption amount W(X) are stored in the storage medium 5.

$$W(X)=W(X-1)+w(X)+v(X) \quad (6)$$

Needless to say, if the CPU 26 determines in step S25 that the toner supply operation is not needed, the CPU 26 sets v(X) in equation (6) to 0 and obtains the total toner consumption amount after printing of the X-th sheet W(X).

The toner that was removed by the cleaning blade 4 is recovered in the toner recovery container 24, and in the case of performing printing, if the per-sheet toner consumption amount Y(X−1) up to that point in time is large, it is envisioned that there will also be a large amount of toner remaining in the vicinity of the cleaning blade 4. Accordingly, in this type of situation, problems in the cleaning performance will not occur even if the toner supply operation is not executed. Thus, the larger the average per-sheet toner consumption amount Y(X−1) up to the point in time of printing is, the smaller the threshold value M(X) is and the less likely the toner supply operation is to be executed, and thereby it is possible to suppress needless consumption of toner.

On the other hand, if the average per-sheet toner consumption amount Y(X−1) up to that point in time is small, it is envisioned that little toner will remain in the vicinity of the cleaning blade 4. Thus, in the present embodiment, the smaller the average per-sheet toner consumption amount Y(X−1) up to the point in time of printing is, the greater the threshold value is, and the more likely the toner supply operation is to be executed, and thereby the cleaning performance is maintained.

Note that in FIG. 4, the threshold value M(X) is inversely proportionate to the per-sheet toner consumption amount Y(X−1), but the present embodiment is not limited to this. For example, it is possible to use an arbitrary relationship in which the threshold value M(X) decreases as the per-sheet toner consumption amount Y(X−1) increases. Also, a configuration is possible in which, if the per-sheet toner consumption amount Y(X−1) increases, the threshold value M(X) does not always decrease, but rather, the threshold value M(X) is fixed with respect to changes in the per-sheet toner consumption amount Y(X−1) within a certain range. For example, as shown in FIG. 5, a table showing the relationship between ranges of the per-sheet toner consumption amount Y(X−1) and the threshold value M(X) can be stored in the non-volatile memory 27, and the threshold value M(X) can be determined based on that table. In other words, it is sufficient that M(X) does not increase as the toner consumption amount Y(X−1) increases.

Also, although the total toner consumption amount W(X) was obtained using equation (6) in the present embodiment, it is also possible to use another method such as detecting the remaining toner amount in the developing unit 23 and obtaining the total toner consumption amount W(X) based on the difference between that and the initial toner amount. Note that the remaining toner amount in the developing unit 23 can be detected using an existing optical sensor, or based on a change in the electrostatic capacity. Note that in the present embodiment, the per-sheet toner consumption amount Y(X−1) is obtained based on the total toner consumption amount and the total number of sheets printed using the cartridge that corresponds to the storage medium 5, which are stored by the storage medium 5. In other words, the per-sheet toner consumption amount Y(X−1) is obtained based on the total number of sheets printed and the total toner consumption amount starting from the time when the cartridge started being used. However, for example, a mode is possible in which the per-sheet toner consumption amount Y(X−1) is obtained based on the number of sheets printed in a period of time from the time of printing up to a predetermined time in the past, and based on the total amount of toner consumed in that period of time. Furthermore, a mode is possible in which a predetermined number of printed sheets is determined in advance, and the per-sheet toner consumption amount Y(X−1) is obtained based on the predetermined past number of printed sheets at a time of printing, and on the total toner consumption amount in the period of printing of that number of printed sheets.

Figure 11:
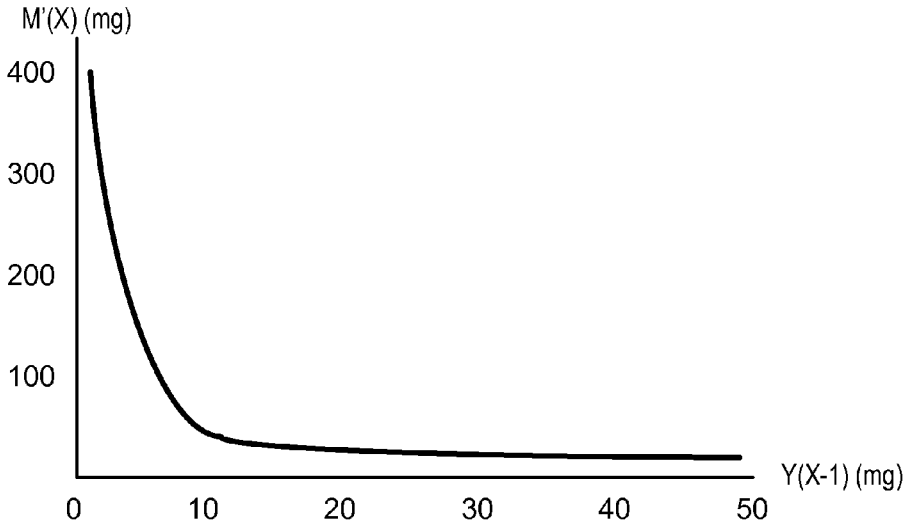
FIG. 11 is a diagram for describing determination of a threshold value for determining whether or not a toner supply operation is necessary according to an embodiment.

Up until this point, a method was disclosed in which the print ratio k(X) and the threshold value M(X) during the image formation for the X-th sheet were compared and it was determined whether or not the toner supply operation was needed. However, the target of comparison is not limited to the print ratio. For example, it is possible to use a method in which it is determined whether or not the toner supply operation is needed by calculating a threshold value M'(X) in place of the threshold value M(X) in step S22 of FIG. 3 and comparing the toner consumption amount w(X) during the image formation for the X-th sheet to the threshold value M'(X) in step S25. That is to say, if the toner consumption amount w(X) is less than or equal to the threshold value M'(X), the toner supply operation is executed, and if the toner consumption amount w(X) is greater than the threshold value M'(X), the toner supply operation is not executed. In other words, the amount of toner (i.e., the amount of developing material) to be supplied to the cleaning blade 4 is set to zero. FIG. 11 shows an example of the relationship between the per-sheet toner consumption amount Y(X−1) and the threshold value M'(X). In this relationship, the threshold value M'(X) decreases overall as the value of Y(X−1) increases.

Note that in the present embodiment, as described above, the toner supply operation is performed and the threshold value is changed in a period from when a developing material image (first developing material image), which is a toner image, is formed on the photosensitive member 1, until the next toner image (second toner image) is to be formed.

Second Embodiment

In the present embodiment, after it is determined whether or not the toner supply operation is needed based on the method described in the first embodiment, the toner amount v(X) that is to be supplied when the toner supply operation is implemented is controlled according to the print ratio k(X) or the toner consumption amount w(X) during the image formation for the X-th sheet. Below, the differences from the first embodiment will be described. Note that the configurations of the image forming apparatus and the like in the present embodiment are similar to those in the first embodiment and therefore the description thereof will not be repeated.

In the present embodiment, the larger the difference is between the threshold value M(X) and the print ratio k(X) in the printing of the X-th sheet, the larger the supply toner amount v(X) in the toner supply operation executed after printing of the X-th sheet is. FIG. 6 shows a relationship between the difference obtained by subtracting k(X) from M(X), and the length (X) in the sub-scanning direction of the toner image that was formed on the photosensitive member 1 in the toner supply operation, which is stored in the non-volatile memory 27 or the RAM 28 in the present embodiment. Based on the relationship in equation (4), the toner amount v(X) that is to be supplied is obtained using equation (7) below.

$$v(X)=\alpha\times 220\times \text{length in sub-scanning direction } (X)\times 0.2 \quad (7)$$

Note that in the present embodiment, the largest value for the length in the main-scanning direction of the toner image formed by the toner supply operation is, for example, 220 mm. This is because the purpose is to supply toner as a lubricant across the entire area in the main-scanning direction of the cleaning blade 4. Also, the density of the toner was 20% uniform halftone. In the present embodiment, as shown in FIG. 6, the amount of toner v(X) to be supplied was controlled by varying the length in the sub-scanning direction, but the present invention is not limited to this. It is possible to use a method in which the amount of toner to be supplied is controlled by changing the length in the main-scanning direction, the halftone density, or any combination thereof including the length in the sub-scanning direction.

In the present embodiment, the smaller the average per-sheet toner consumption amount Y(X−1) during printing is, the larger M(X) is, as was described in the first embodiment. Accordingly, if M(X) is large, it can be envisioned that there will be a small amount of toner remaining in the vicinity of the cleaning blade 4. Also, if the print ratio k(X) is small, the amount of transfer remnant toner during the printing of the X-th sheet will also decrease. Accordingly, the larger the difference between M(X) and k(X) is, the smaller the amount of toner remaining in the vicinity of the cleaning blade 4 is. Accordingly, in the present embodiment, the larger the difference between M(X) and k(X) is, the greater the toner amount v(X) that is to be supplied in the toner supply operation is set in order to maintain the cleaning performance. Thus, it is possible to suppress needless consumption of toner while maintaining the cleaning performance. Note that FIG. 6 shows the length in the sub-scanning direction (X) with respect to a difference obtained by subtracting k(X) from M(X) (i.e., the supply toner amount v(X)), and if k(X) is larger than M(X), the supply toner amount v(X) is zero, and the toner supply operation is not performed, as was described in the first embodiment.

Up until this point, a method was described in which the toner amount v(X) to be supplied during the implementation of the toner supply operation is calculated based on the difference between the threshold value M(X) and the print ratio k(X). Alternatively, it is possible to use a method in which the toner amount v(X) to be supplied during the implementation of the toner supply operation is calculated based on the difference between the threshold value M'(X), which was described in the first embodiment as well, in place of the threshold value M(X), and the toner consumption amount w(X) during the image formation for the X-th sheet. It is sufficient that as the difference between M'(X) and w(X) increases, the toner amount v(X) that is to be supplied with the toner supply operation is increased.

Third Embodiment

As the number of printed sheets increases, the toner held by the developing unit 23 gradually deteriorates, and accordingly, the quality of the image that is formed also deteriorates. In the present embodiment, the number of printed sheets Xd at which image quality starts to deteriorate is stored in the non-volatile memory 27 or the storage medium 5 in advance as a target number of printed sheets, and the setting of the threshold value M(X) is performed such that at least Xd sheets are printed. Below, the present embodiment will be described focusing on the differences from the first embodiment.

Figure 7:
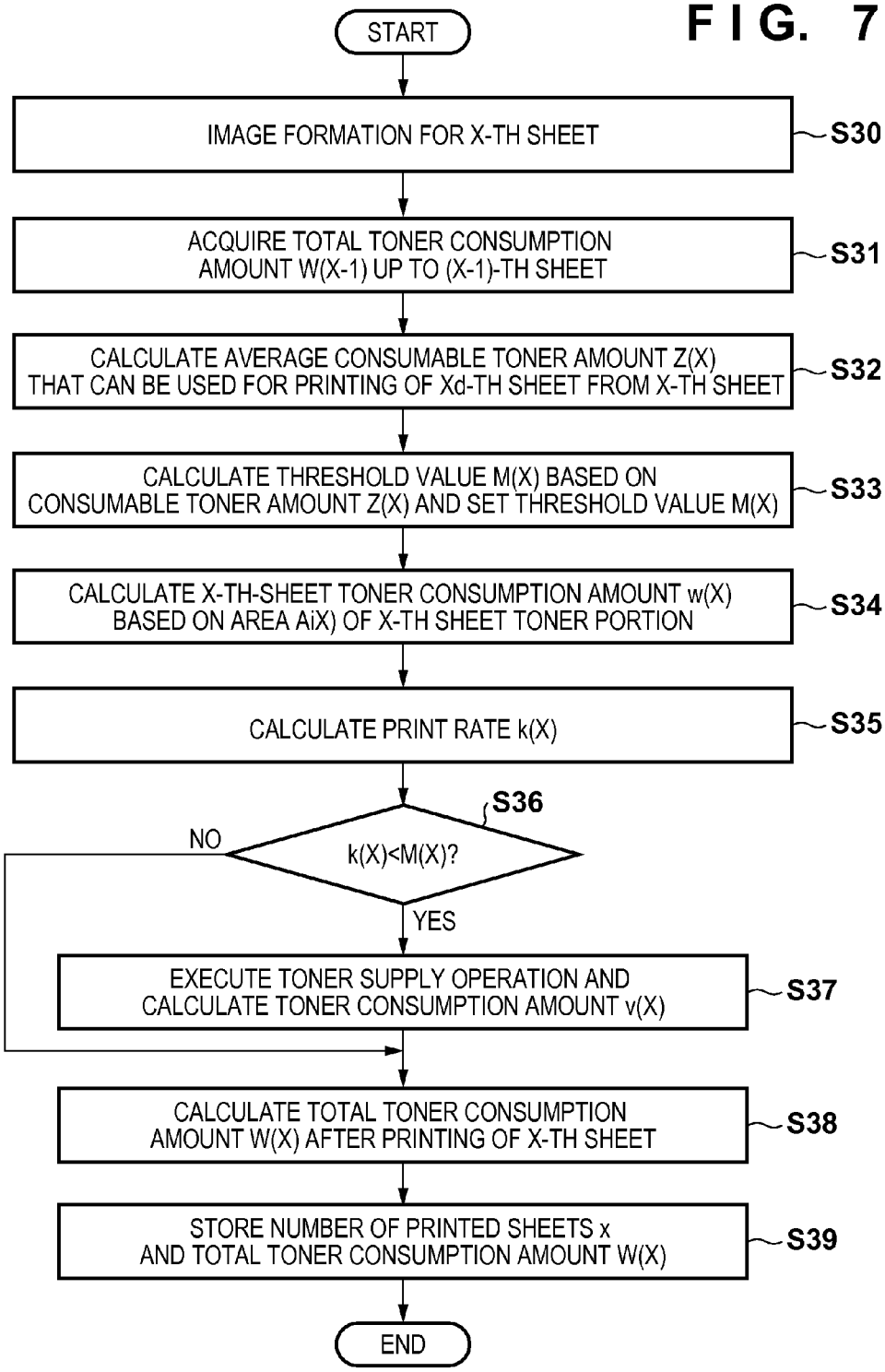
FIG. 7 is a flowchart of print processing according to an embodiment.

FIG. 7 is a flowchart of print processing according to the present embodiment. The CPU 26 performs image formation for the X-th sheet in step S30 and reads out the total number of printed sheets up to the current time, or in other words, the value (X−1) and the total toner consumption amount W(X−1) up to the current time from the storage medium 5 in step S31. Note that X is a value that is smaller than Xd, which is also the target minimum number of printed sheets. Next, in step S32, the CPU 26 calculates an average per-sheet consumable toner amount Z(X) (i.e., an average per-sheet amount of consumable developing material amount Z(X−1)) when printing up to the Xd-th sheet after the printing of the X-th sheet, according to equation (8) below.

$$Z(X)=(Wi-W(X-1))/(Xd-(X-1)) \quad (8)$$

Here, Wi is the initial value for the amount of toner that is held in the developing unit 23, and accordingly, Wi−W(X−1) is the amount of toner held by the developing unit 23 directly before the X-th sheet is printed. Next, in step S33, the CPU 26 calculates the threshold value M(X) based on the consumable toner amount Z(X) that was obtained in step S32. For example, a case will be described in which the print ratio k(X) is set to the threshold value M(X) in the case where the toner consumption amount w(X) during the printing of the X-th sheet is equal to Z(X). The area Ai(X) of the toner portion on the X-th printed sheet is expressed by equation (9) below, based on equation (3).

$$Ai(X)=Z(X)/\alpha \quad (9)$$

Accordingly, based on equation (1), the threshold value M(X) is:

$$k(X)=Ai(X)/At=Z(X)/(\alpha\times At)=M(X) \quad (10)$$

Figure 8:
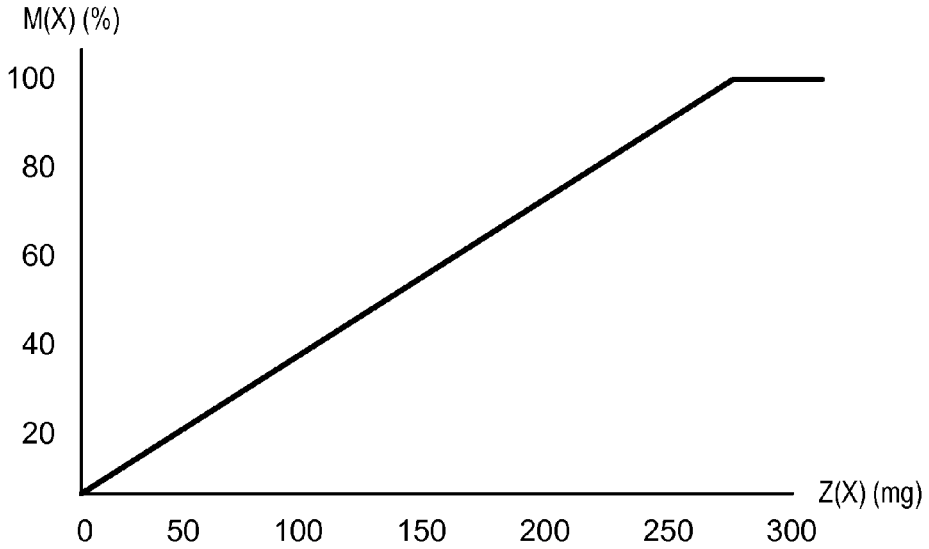
FIG. 8 is a diagram for describing determination of a threshold value for determining whether or not a toner supply operation is necessary according to an embodiment.

For example, as shown in FIG. 8, the threshold value M(X) is in a proportional relationship with the consumable toner amount Z(X) within a range up to the threshold value M(X) being 100%. Note that the present invention is not limited to only causing the threshold value M(X) and the consumable toner amount Z(X) to be proportional, and it is possible to use an arbitrary relationship in which the threshold value M(X) increases as the consumable toner amount Z(X) increases. Also, as long as the threshold value M(X) does not decrease as the consumable toner amount increases, it is possible to have a relationship in which the threshold value M(X) is fixed regardless of a certain extent of change in the consumable toner amount Z(X). The CPU 26 sets M(X), which was calculated in step S33, in the RAM 28. Since the subsequent processing from step S34 to step S39 is similar to the processing from step S23 to step S28 shown in FIG. 3, the description thereof will not be repeated.

Note that although α is a fixed value in FIG. 8, the value of α sometimes fluctuates due to the environmental temperature and humidity, the usage history of the cartridge, or the like, and a configuration is thereby possible in which the threshold value M(X) is calculated using a combination of the two values Z(X) and α.

In the present embodiment, the threshold value M(X) is set such that image formation for a pre-set number of sheets Xd or more is possible. Note that it is possible to determine the threshold value M(X) using a table such as that shown in FIG. 9A, rather than using a mode in which the threshold value M(X) is obtained using the graph shown in FIG. 8, or using an equation corresponding to that graph. The table in FIG. 9A is stored in advance in the non-volatile memory 27 and shows the threshold values M(X) with respect to ranges of future per-sheet toner consumption amounts Z(X). Needless to say, if α is a variable, the threshold value M(X) is determined using a two-dimensional table of the toner consumption amount Z(X) and α.

Furthermore, it is also possible to determine the threshold value M(X) based on a two-dimensional table of the number of printed sheets up to that point in time (X−1) and the remaining toner amount Wi-W(X−1), such as that shown in FIG. 9B. In the table in FIG. 9B, Xd is 10000, and the initial value of the toner amount in the developing unit 23 is 200 g.

Note that when the number of printed sheets exceeds Xd at which image quality starts to deteriorate, it can be said that it is necessary to exchange the cartridges. Because of this, the configuration is such that M(X) is 100% and the toner supply operation is always executed when the number of printed sheets is Xd or more in the table shown in FIG. 9B. Additionally, although the remaining toner amount in the developing unit 23 was obtained using the difference between the initial toner amount Wi and the toner consumption amount W(X−1) up to that point in time, a mode is possible in which the remaining toner amount in the developing unit 23 is measured directly, as described in the first embodiment. Moreover, in the present embodiment as well, the toner amount v(X) that is to be supplied during the toner supply operation may be made variable based on the threshold value M(X) and the print ratio k(X) of the X-th sheet, similarly to the second embodiment.

Up until this point, a method was disclosed in which the print ratio k and the threshold value M(X) during the image formation for the X-th sheet were compared and it was determined whether or not the toner supply operation is needed. In addition to that, similarly to the first embodiment, it is possible to use a method in which it is determined whether or not the toner supply operation is needed by calculating a threshold value M'(X) in place of the threshold value M(X) in step S33 of FIG. 7 and comparing the toner consumption amount w(X) during the image formation for the X-th sheet to the threshold value M'(X) in step S36. That is to say, if the toner consumption amount w(X) is less than or equal to the threshold value M'(X), the toner supply operation is executed, and if the toner consumption amount w(X) is greater than the threshold value M'(X), the toner supply operation is not executed, or in other words, the amount of toner (i.e. amount of developing material) that is to be supplied to the cleaning blade 4 is set to zero. Additionally, it is possible to use Z(X−1) for example, which is the average per-sheet consumable developing material amount, as the threshold value M'(X). That is to say that as the value of Z(X−1) increases, the threshold value M'(X) also increases overall.

Additionally, it is possible to control the toner amount v(X) that is to be supplied when the toner supply operation is implemented according to the print ratio k(X) or the toner consumption amount w(X) during the image formation for the X-th sheet, using a method similar to that of the second embodiment. That is to say, the bigger the difference is between the threshold value M'(X) and the toner consumption amount w(X), or between the threshold value M(X) and the print ratio k(X), the larger the toner amount v(X) that is to be supplied is.

Fourth Embodiment

Figure 10:
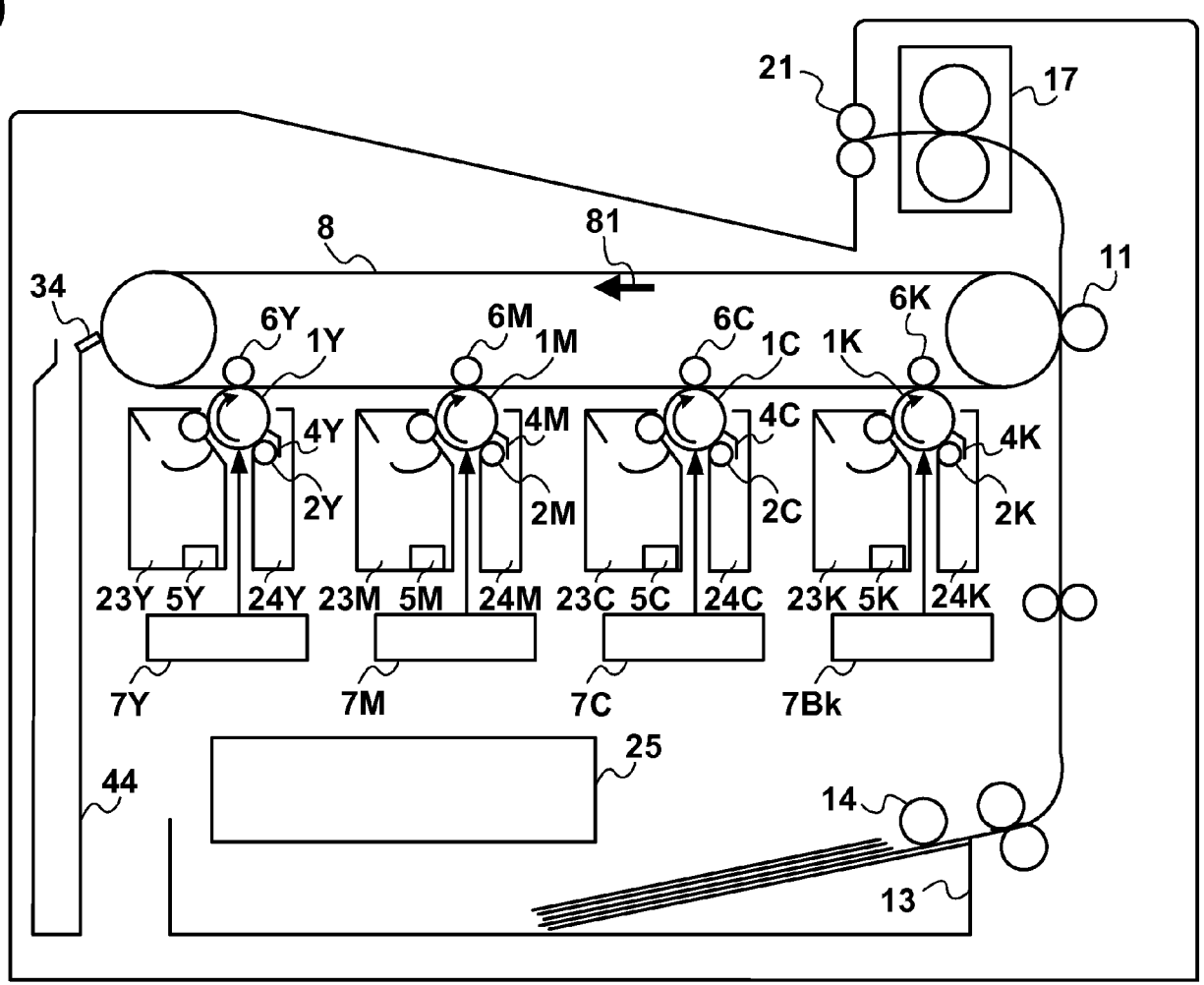
FIG. 10 is a schematic configuration diagram of the image forming apparatus according to an embodiment.

In the present embodiment, a description will be given for a toner supply operation for a cleaning blade that removes toner on an intermediate transfer belt in a color image forming apparatus. FIG. 10 is a schematic configuration diagram of a full-color image forming apparatus that uses an intermediate transfer belt 8. Note that in FIG. 10, constituent elements that are similar to those in the image forming apparatus in FIG. 1 are denoted by the same reference numerals and a detailed description thereof will not be repeated. Also, in FIG. 10, members that have Y, M, C, and K appended to their reference numerals are members for respectively forming a yellow (Y), magenta (M), cyan (C), and black (K) toner image on the intermediate transfer belt 8. Note that reference numerals that do not include Y, M, C, or K at the end are used when there is no need to distinguish between these colors.

Corresponding color toner images are formed on the photosensitive member 1 that correspond to the colors in the image forming apparatus in FIG. 10, similarly to the description in the first embodiment. The transfer rollers 6 that correspond to the photosensitive members 1 apply a transfer bias, and the toner images on the corresponding photosensitive members 1 are transferred to the intermediate transfer belt 8, which is an intermediate transfer member that is rotated in the direction of an arrow 81 in the drawing. A recording material in the cassette 13 is conveyed to the nip portion between the transfer roller 11 and the intermediate transfer belt 8 by the roller 14 and the like. The transfer roller 11 applies a bias having a positive polarity and transfers the toner images on the intermediate transfer belt 8 to the recording material that is conveyed. Thereafter, the recording material passes through the fixing unit 17 and is ejected to the outside of the apparatus by the roller 21, similarly to the first embodiment. Transfer remnant toner that is not transferred to the recording material and remains on the intermediate transfer belt 8 is removed by a cleaning blade 34 and recovered in a toner recovery container 44. Furthermore, similarly to the first embodiment, the photosensitive members 1, the chargers 2, the developing units 23, the cleaning blades 4, and the toner recovery containers 24 that correspond to the various colors are configured as cartridges that are detachable from the image forming apparatus. Also, the cartridges have storage mediums 5Y, 5M, 5C, and 5K. The storage mediums 5Y, 5M, 5C, and 5K store Xy, Xm, Xc, and Xk, which are the numbers of printed sheets up to that point in time, and the total toner consumption amounts Wy(X), Wm(X), Wc(X), and Wk(X) up to that point in time, and the like, similarly to the first embodiment.

The cleaning blade 34 is a blade for removing transfer remnant toner on the intermediate transfer belt 8, and the material thereof and the method of pressing it against the intermediate belt 8 are similar to those of the cleaning blade 4. Accordingly, by supplying toner as a lubricant to the cleaning blade 34 as needed, similarly to the first embodiment, friction between the cleaning blade 34 and the intermediate transfer belt 8 is reduced. The timing at which it is determined whether or not to execute the toner supply operation for the cleaning blade 34 is similar to that of the first embodiment. If the toner supply operation for the cleaning blade 34 is to be executed, a toner image is formed on at least one photosensitive member 1 and is transferred to the intermediate transfer belt 8. Additionally, at this time, toner passes through the nip portion between the transfer roller 11 and the intermediate transfer belt 8 due to the transfer roller 11 being separated from the intermediate transfer belt 8, or due to a bias having a negative polarity that is the same as that of the toner being applied from the transfer roller 11. Due to having this configuration, toner that functions as a lubricant is supplied to the cleaning blade 34.

Note that if toner is to be supplied to a cleaning blade 4 as well, for example, the toner is first supplied to the cleaning blade 4 similarly to the first embodiment, and thereafter the toner is supplied to the cleaning blade 34. Note that it is also possible to supply toner first to the cleaning blade 34 and thereafter supply the toner to the cleaning blade 4. Also, the transfer rollers 6Y to 6K are brought into contact with the intermediate transfer belt 8, and the transfer bias is switched off, or the transfer bias is reduced to a value lower than the necessary value. With this configuration, the amount of toner that is to be transferred to the intermediate transfer belt 8 can be adjusted, and toner can be supplied to both the cleaning blade 4 and the cleaning blade 34 at the same time.

In the present embodiment, the determination of whether or not the toner supply operation for the cleaning blade 4 is needed is made independently for each color according to equation (1). Specifically, the toner supply operation for the cleaning blade 4 is executed for each color using the print ratios ky, km, kc, and kk for the colors, and the threshold values My, Mm, Mc, and Mk for the colors. At this time, a toner image is formed on the intermediate transfer belt 8 as well using the members for executing the toner supply operation for the cleaning blade 4, and toner is supplied to the cleaning blade 34 as well.

For example, if the print ratios for all colors are at or above the corresponding threshold, there is a large amount of toner in the toner images that were transferred to the intermediate transfer belt 8, and accordingly, it is anticipated that there will be a large amount of transfer remnant toner on the intermediate transfer belt 8. Accordingly, in this case, the cleaning performance can be maintained without performing the toner supply operation, since the transfer remnant toner serves the role of a lubricant. By implementing this kind of control, toner can be prevented from being needlessly consumed.

On the other hand, if a print ratio is lower than the corresponding threshold value, the toner supply operation is performed in order to maintain the cleaning performance, and in the present embodiment, toner is supplied from only the developing unit 23 of the color for which the print ratio is lower than the corresponding threshold value. According to this configuration, it is possible to supply toner from only the developing unit 23 whose toner was not used much for image formation. Note that it is possible to set the threshold values My to Mk using a method that is similar to those in the embodiments described above.

As described above, in the present embodiment as well, it is possible to reduce unnecessary toner supply operations for the cleaning blades 4 and 34. Also, since only the developing unit 23 that corresponds to a color for which the print ratio was below the threshold value performs the supply of toner to the cleaning blade 34, it is possible to prevent the toner consumption amounts in the colors from being disproportionate.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-276113, filed on Dec. 18, 2012, which is hereby incorporated by reference herein in its entirety.

What is claimed is:

1. An image forming apparatus comprising:

an image carrier;

an image forming unit configured to form a developing material image on the image carrier using a developing material;

a cleaning unit configured to remove a remaining amount of the developing material that was not transferred from the image carrier to another member; and a control unit configured to, in order to supply the developing material to the cleaning unit, control the image forming unit such that a developing material image that is not to be transferred to the other member is formed on the image carrier, wherein the control unit is further configured to, if a developing material image that is to be transferred to the other member is formed on the image carrier, obtain a print ratio that is a ratio of the area of the formed developing material image with respect to the area of a developing material image capable of being formed on the other member, and control an amount of the developing material that is to be supplied to the cleaning unit in accordance with the print ratio and a threshold value, and wherein the control unit is further configured to obtain the threshold value based on a consumption amount of the developing material in the image forming unit and a number of sheets of recording material printed by the image forming unit.

2. The image forming apparatus according to claim 1, wherein the control unit is further configured to, if the print ratio is larger than the threshold value, set the amount of the developing material that is to be supplied to the cleaning unit to zero.

3. The image forming apparatus according to claim 1, wherein the control unit is further configured to, if the print ratio is smaller than the threshold value, perform supply of the developing material to the cleaning unit.

4. The image forming apparatus according to claim 1, wherein the control unit is further configured to, if the developing material is to be supplied to the cleaning unit, determine the amount of the developing material that is to be supplied to the cleaning unit in accordance with a difference between the print ratio and the threshold value.

5. The image forming apparatus according to claim 4, wherein the control unit is further configured to control the image forming unit such that as the difference between the print ratio and the threshold value increases, the amount of the developing material that is to be supplied to the cleaning unit is maintained or increased.

6. An image forming apparatus comprising:

an image carrier;

an image forming unit configured to form a developing material image on the image carrier using a developing material;

a cleaning unit configured to remove a remaining amount of the developing material that was not transferred from the image carrier to another member; and a control unit configured to, in order to supply the developing material to the cleaning unit, control the image forming unit such that a developing material image that is not to be transferred to the other member is formed on the image carrier, wherein the control unit is further configured to, if a developing material image that is to be transferred to the other member is formed on the image carrier, obtain a consumption amount of the developing material image that was formed on the other member, and control an amount of the developing material that is to be supplied to the cleaning unit in accordance with the consumption amount and a threshold value, and wherein the control unit it further configured to obtain the threshold value based on the consumption amount of the developing material in the image forming unit and a number of sheets printed by the image forming unit.

7. The image forming apparatus according to claim 6, wherein the control unit is further configured to, if the consumption amount of the developing material image that was formed on the other member is larger than the threshold value, set the amount of the developing material that is to be supplied to the cleaning unit to zero.

8. The image forming apparatus according to claim 6, wherein the control unit is further configured to, if the consumption amount of the developing material image that was formed on the other member is smaller than the threshold value, supply the developing material to the cleaning unit.

9. The image forming apparatus according to claim 6, wherein the control unit is further configured to, if the developing material is to be supplied to the cleaning unit, determine the amount of developing material that is to be supplied to the cleaning unit in accordance with a difference between the consumption amount of the developing material image that was formed on the other member, and the threshold value.

10. The image forming apparatus according to claim 9, wherein the control unit is further configured to control the image forming unit such that as the difference between the consumption amount of the developing material image that was formed on the other member and the threshold value increases, the amount of the developing material that is to be supplied to the cleaning unit is maintained or increased.

11. The image forming apparatus according to claim 1, wherein the control unit is further configured to change the threshold value in accordance with a per-sheet developing material consumption amount that was obtained based on a consumption amount of the developing material in the image forming unit and the number of sheets printed by the image forming unit in a period from a first time point to a second time point at a time of printing later than the first time point.

12. The image forming apparatus according to claim 1, wherein the number of sheets printed by the image forming unit is a number of sheets printed in a period from a first time point at a time when the image forming unit starts to be used to a second time point at a time of printing later than the first time point.

13. The image forming apparatus according to claim 1, wherein the control unit is further configured to change the threshold value in accordance with a predetermined past number of printed sheets at a time point at a time of printing, and a per-sheet developing material consumption amount that was obtained based on a consumption amount of developing material in the image forming unit during a period of printing the predetermined past number of printed sheets.

14. The image forming apparatus according to claim 11, wherein the control unit is further configured to perform control such that as the per-sheet developing material consumption amount increases, the threshold value is maintained or decreased.

15. The image forming apparatus according to claim 1, wherein the control unit is further configured to perform control such that as the consumption amount of developing material in the image forming unit increases in a period from a first time point to a second time point at a time of printing later than the first time point, the threshold value is maintained or decreased, and as the number of sheets printed by the image forming unit increases, the threshold value is maintained or increased.

16. An image forming apparatus comprising:

an image carrier;

an image forming unit configured to form a developing material image on the image carrying unit using a developing material;

a cleaning unit configured to remove a remaining amount of the developing material that was not transferred from the image carrier to another member; and a control unit configured to, in order to supply developing material to the cleaning unit, control the image forming unit such that a developing material image that is not to be transferred to the other member is formed on the image carrier, wherein the control unit is further configured to, if a developing material image that is to be transferred to the other member is formed on the image carrier, obtain a print ratio that is a ratio of the area of the formed developing material image with respect to the area of a developing material image capable of being formed on the other member, and control an amount of the developing material that is to be supplied to the cleaning unit in accordance with the print ratio and a threshold value, wherein the control unit is further configured to obtain the threshold value based on the remaining amount of the developing material in the image forming unit and a number of sheets of recording material printed by the image forming unit.

17. An image forming apparatus comprising:

an image carrier;

an image forming unit configured to form a developing material image on the image carrier using a developing material;

a cleaning unit configured to remove a remaining amount of the developing material that was not transferred from the image carrier to another member; and a control unit configured to, in order to supply developing material to the cleaning unit, control the image forming unit such that a developing material image that is not to be transferred to the other member is formed on the image carrier, wherein the control unit is further configured to, if the developing material image that is to be transferred to the other member is formed on the image carrier, obtain a consumption amount for a developing material image that was formed on the other member, and control an amount of the developing material that is to be supplied to the cleaning unit in accordance with the consumption amount and a threshold value, wherein the control unit is further configured to obtain the threshold value based on the remaining amount of the developing material in the image forming unit and a number of sheets of recording material printed by the image forming unit.

18. The image forming apparatus according to claim 16, wherein the control unit is further configured to, based on the remaining amount of the developing material and the number of sheets printed by the image forming unit, calculate an average per-sheet consumable developing material amount that can be used in the case of printing up to a target number of printed sheets using the image forming unit, and change the threshold value in accordance with the per-sheet developing material consumption amount.

19. The image forming apparatus according to claim 18, wherein the control unit is further configured to perform control such that as the average per-sheet consumable developing material amount increases, the threshold value is maintained or increased.

20. The image forming apparatus according to claim 18, wherein the control unit is further configured to, if the number of sheets printed by the image forming unit exceeds the target number of printed sheets, always supply the developing material to the cleaning unit after printing.

21. The image forming apparatus according to claim 16, wherein the control unit is further configured to perform control such that as the remaining amount of the developing material in the developing unit decreases, the threshold value is maintained or decreased, and as the number of sheets printed by the image forming unit increases, the threshold value is maintained or increased.

22. The image forming apparatus according to claim 1, wherein the developing material is supplied to the cleaning unit in a period from when a first developing material image has been formed on the image carrier until when a second developing material image is formed subsequently to the first developing material image.

23. The image forming apparatus according to claim 22, wherein the threshold value is changed in a period from when a first developing material image has been formed on the image carrier until when a second developing material image is formed subsequently to the first developing material image.

24. The image forming apparatus according to claim 1, wherein the image carrier, the cleaning unit, and the image forming unit are provided in correspondence with each of a plurality of colors to be used in image formation, and the control unit is further configured to, individually for each cleaning unit, determine whether or not to supply the developing material to the cleaning unit.

25. The image forming apparatus according to claim 24, further comprising:

an intermediate transfer member onto which a developing material image that was formed on an image carrier is transferred; and a second cleaning unit configured to remove remaining developing material that was not transferred from the intermediate transfer member to a recording material, wherein the control unit is further configured to, if the developing material is to be supplied to at least one cleaning unit that corresponds to an image carrier, also supply the developing material to the second cleaning unit that corresponds to the intermediate transfer member.

26. An image forming apparatus comprising:

an image carrier;

an image forming unit configured to form a developing material image on the image carrier using a developing material;

a cleaning unit configured to remove a remaining amount of the developing material that was not transferred from the image carrier to another member; and a control unit configured to, in order to supply the developing material to the cleaning unit, control the image forming unit such that a developing material image that is not to be transferred to the other member is formed on the image carrier, wherein the control unit is further configured to obtain a threshold value for controlling an amount of the developing material that is to be supplied to the cleaning unit in a period from when a first developing material image that is to be transferred to the other member is formed, until when a second developing material image is formed subsequently to the first developing material image.

27. The image forming apparatus according to claim 1, wherein the threshold value is updated when a developing material image that is to be transferred to the other member is formed.

28. The image forming apparatus according to claim 6, wherein the threshold value is updated when a developing material image that is to be transferred to the other member is formed.

29. The image forming apparatus according to claim 16, wherein the threshold value is updated when a developing material image that is to be transferred to the other member is formed.

30. The image forming apparatus according to claim 17, wherein the threshold value is updated when a developing material image that is to be transferred to the other member is formed.

* * * * *